US007762552B2

(12) United States Patent
Guerand et al.

(10) Patent No.: US 7,762,552 B2
(45) Date of Patent: Jul. 27, 2010

(54) MOVABLE GATE WITH FLUID DAMPER FOR DIRECTING MEDIA SHEETS WITHIN AN IMAGE FORMING APPARATUS

(75) Inventors: Daniel Guerand, Lexington, KY (US); Robert Rosacker, Georgetown, KY (US); Scott S. Williams, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 122 days.

(21) Appl. No.: 11/924,655

(22) Filed: Oct. 26, 2007

(65) Prior Publication Data

US 2009/0108517 A1 Apr. 30, 2009

(51) Int. Cl.
*B65H 39/10* (2006.01)

(52) U.S. Cl. ..... 271/303; 271/225; 271/184

(58) Field of Classification Search ..... 271/303, 271/225, 184; 188/290, 291, 292
See application file for complete search history.

(56) References Cited

U.S. PATENT DOCUMENTS

| | | | | |
|---|---|---|---|---|
| 4,228,996 | A | 10/1980 | Wilcox, Jr. | |
| 4,300,758 | A | 11/1981 | Peter, III | |
| 4,614,004 | A * | 9/1986 | Oshida | 16/82 |
| 4,638,528 | A * | 1/1987 | Omata | 16/82 |
| 4,660,963 | A | 4/1987 | Stemmle | |
| 4,699,365 | A | 10/1987 | Smith et al. | |
| 4,793,605 | A | 12/1988 | Tajima | |
| 4,901,117 | A | 2/1990 | Derrick | |
| 4,979,727 | A | 12/1990 | Koike et al. | |
| 4,986,529 | A | 1/1991 | Agarwal et al. | |
| 4,998,716 | A | 3/1991 | Okumura et al. | |
| 5,042,790 | A | 8/1991 | Miller et al. | |
| 5,093,690 | A | 3/1992 | Ohno et al. | |
| 5,153,663 | A | 10/1992 | Bober et al. | |
| 5,201,518 | A | 4/1993 | Isoda | |
| 5,234,213 | A | 8/1993 | Chen | |
| 5,263,708 | A | 11/1993 | Hacknauer | |
| 5,539,510 | A | 7/1996 | Yamashiro et al. | |
| 5,590,872 | A | 1/1997 | Oominami et al. | |
| 5,702,341 | A * | 12/1997 | Keilhau | 493/426 |
| 5,718,309 | A * | 2/1998 | Kariya | 188/290 |
| 5,882,130 | A | 3/1999 | Kumazaki et al. | |
| 5,974,298 | A | 10/1999 | Urban et al. | |
| 6,032,949 | A | 3/2000 | Ando | |
| 6,032,950 | A | 3/2000 | Ikeda | |

(Continued)

*Primary Examiner*—Kaitlin S Joerger

(57) ABSTRACT

The present application is directed to devices and methods for directing media sheets moving along a media path within an image forming apparatus. In one embodiment, a gate is positioned in proximity to the media path. The gate may include an elongated shape that extends across at least a section of the media path. A fluid damper may be operatively connected to the gate and may include a shaft and a chamber that holds fluid. The shaft is rotationally positioned with a first section within the chamber and a second section extending outward from the chamber. Rotation of the shaft in a first direction may force the fluid within the chamber to move relative to the body and cause the gate to move to a first position in the media path to direct the media sheets towards a first part of the media path. Rotation of the shaft in a second direction may force the fluid within the chamber to move relative to the body and cause the gate to move to a second position to direct the media sheets towards a second part of the media path.

17 Claims, 8 Drawing Sheets

U.S. PATENT DOCUMENTS 6,152,443 A 11/2000 Claramunt et al.
6,244,591 B1 6/2001 Paulat
6,290,410 B1 9/2001 Sunada et al.
6,574,569 B1 6/2003 Omata et al.
7,353,923 B2 * 4/2008 Seto et al. ..... 188/290
7,424,939 B2 * 9/2008 Hayashi et al. ..... 188/290
7,431,293 B2 * 10/2008 Carter et al. ..... 271/303
2002/0135124 A1 * 9/2002 Suzuki et al. ..... 271/303
2003/0044208 A1 * 3/2003 Kouno ..... 399/406
2008/0253893 A1 * 10/2008 Nishiyama ..... 416/169 R

* cited by examiner

MOVABLE GATE WITH FLUID DAMPER FOR DIRECTING MEDIA SHEETS WITHIN AN IMAGE FORMING APPARATUS

BACKGROUND

The present application is directed to devices and methods for moving media sheets within an image forming apparatus and, more particularly, to methods and devices of using a fluid damper for moving a gate to direct the media sheets.

An image forming apparatus moves media sheets along a media path. A normal media path begins with an input section for introducing the media sheets. The media path includes a transfer area where the media sheets receive an image. The media path further may further include a duplex area where the media sheets can be inverted and reintroduced into the media path upstream from the transfer area to receive another image on a second side. The media path may further include an output section where the media sheets exit from the image forming apparatus.

The media path may include a gate that directs the media sheets. The gate may be positioned at a variety of locations along the path, from the input section, transfer area, duplex area, and output section. The gate may be movable to selectively direct the media sheets towards the desired sections of the path.

Conventionally, a solenoid, motor, or cam driven device is used to move the gate. However, these devices include various drawbacks including the expense. It may be desirable to construct an image forming apparatus in an economical manner as price is often a major factor in the purchasing decision of consumers. Another drawback to using the devices mentioned previously is the amount of noise they generate. Because image forming apparatus are often utilized in quiet environments such as offices, workstations, and the like, it is desirable to minimize the amount of device noise.

SUMMARY

The present application is directed to devices and methods for directing media sheets moving along a media path within an image forming apparatus. In one embodiment, a gate is positioned in proximity to the media path. The gate may include an elongated shape that extends across at least a section of the media path. A fluid damper may be operatively connected to the gate and may include a shaft and a chamber that holds fluid. The chamber may be located within the body of the fluid dampener. The shaft is rotationally positioned with a first section within the chamber and a second section extending outward from the chamber. Additionally, a plurality of paddles may be included on the first section of the shaft. Rotation of the shaft in a first direction may force the fluid within the chamber to move relative to the body and cause the gate to move to a first position in the media path to direct the media sheets towards a first part of the media path. Rotation of the shaft in a second direction may force the fluid within the chamber to move relative to the body and cause the gate to move to a second position to direct the media sheets towards a second part of the media path.

DETAILED DESCRIPTION

Figure 1:
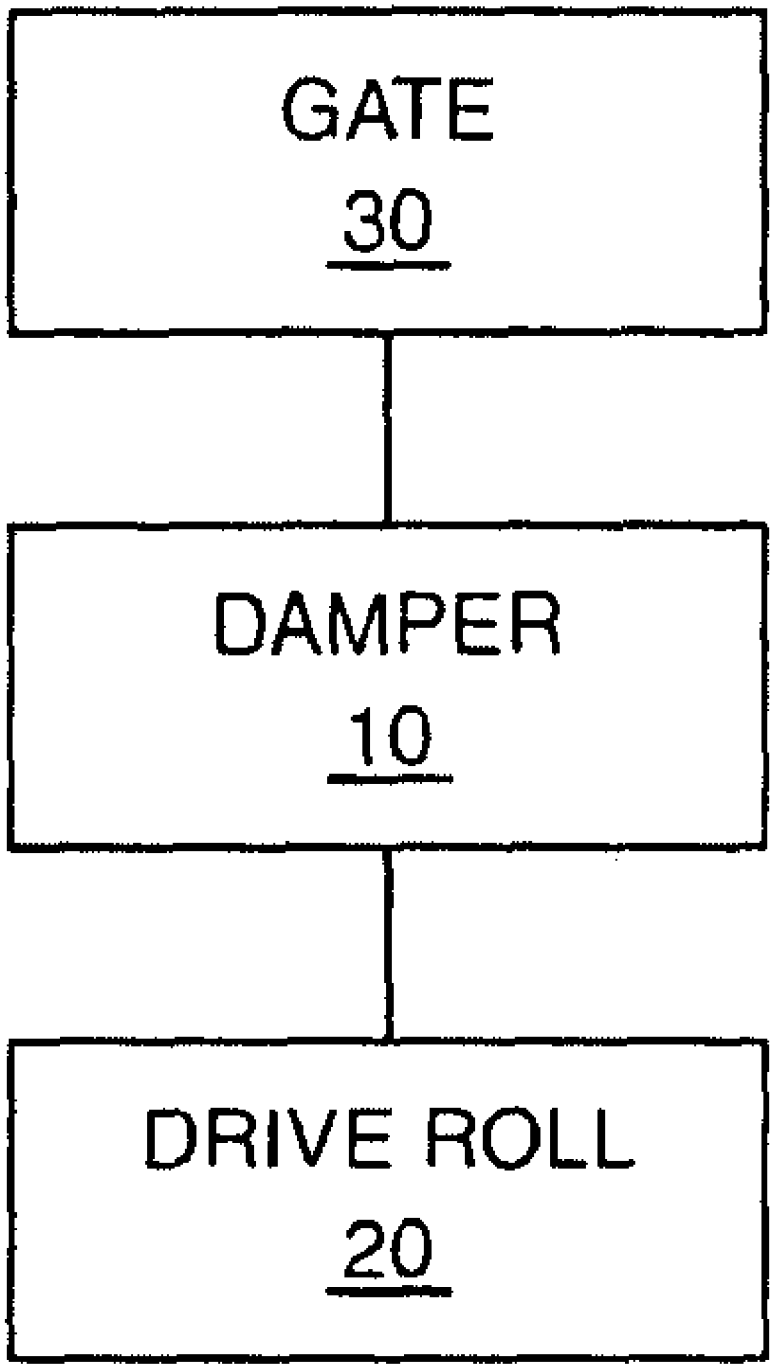
FIG. 1 is a schematic diagram of a damper that is operatively positioned between a gate and a drive roll according to one embodiment.

The present application is directed to devices and methods of directed media sheets along a media path within an image forming apparatus. As illustrated in FIG. 1, a damper 10 is operatively connected to a drive roll 20 and a gate 30. The gate 30 is movable between first and second positions to direct the media sheets as they move along the media path. Further, the drive roll 20 may be operated in a first rotational direction and a second rotational direction. The damper 10 positions the gate 30 between the first and second positions based on the rotational direction of the drive roll 20. Compared to previous designs that use solenoids or stepper motors, the damper 10 is relatively quiet, responds quickly to changes in the rotational direction of the drive roll 20, and provides an extended overall life.

Figure 2:
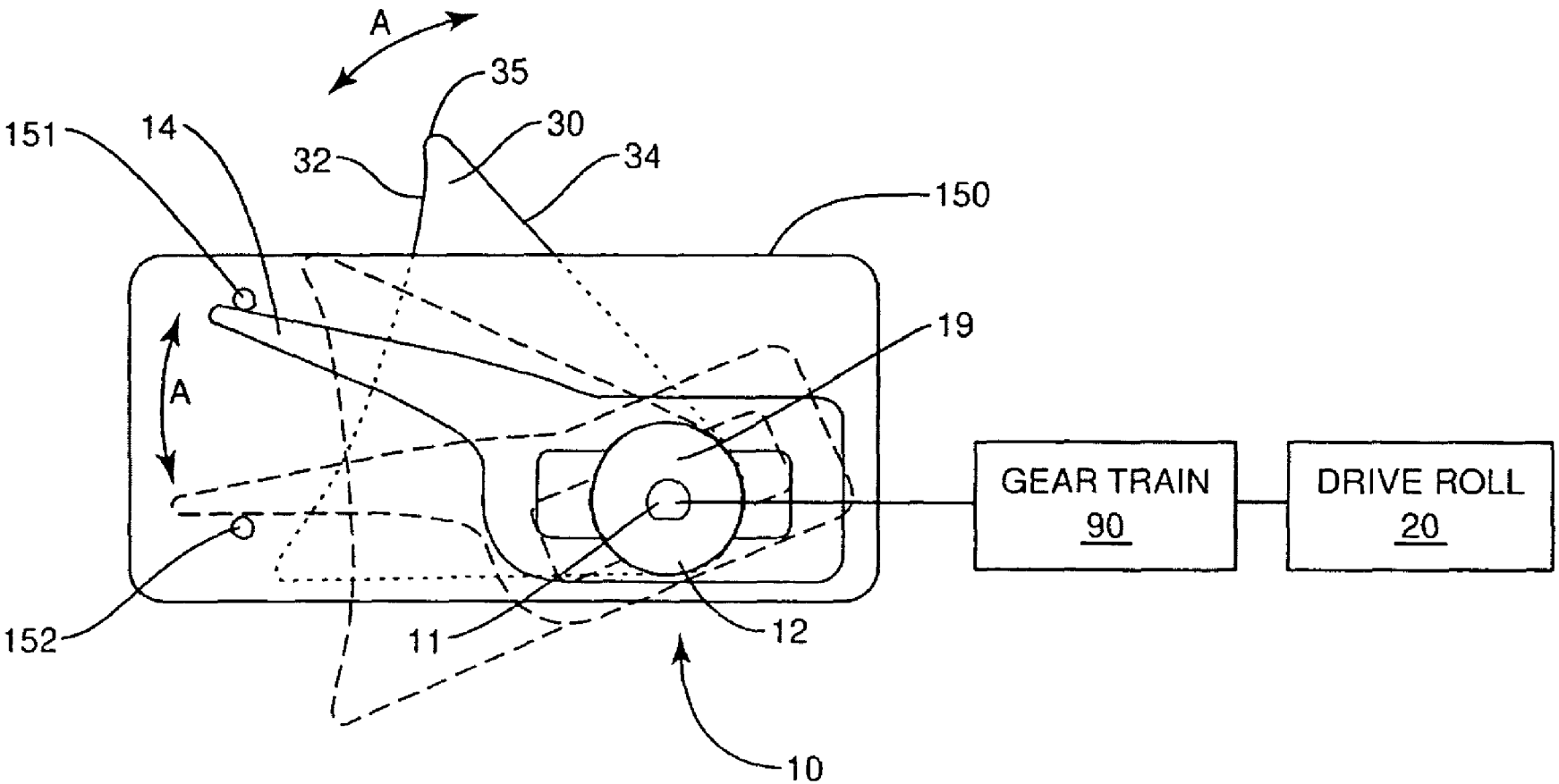
FIG. 2 is a side view of a fluid damper and gate operatively connected with a drive roll according to one embodiment.

FIG. 2 includes one embodiment with the damper 10 positioned between the drive roll 20 and the gate 30. The damper 10 is operatively connected to the drive roll 20 through a gear train 90. Damper 10 includes a body 19 with a chamber 12 that holds a fluid. A shaft 11 is rotationally mounted to the body 19 with a first end extending into the chamber 12 and a second end extending outward from the chamber 12. One or more paddles (not illustrated) extend outward from the shaft 11 within the chamber 12. The gate 30 is attached to the body 19 and includes a substantially triangular shape with a tip 35 formed by media edge 34 and a corresponding edge (not illustrated). Gate 30 further includes an arm 14 that extends outward between stops 151, 152. The damper 10 and gate 30 are movably connected to a housing 150.

The shaft 11 is rotated in forward and reverse directions based on the rotational direction of the drive roll 20. During an initial amount of rotation in the first direction, the shaft 11 and body 19 rotate together due to the frictional force generated by the fluid motion within the chamber 12 causing the gate 30 to rotate to the first position. The extent of rotation of the body 19 and the gate 30 is limited by the arm 14 contacting against the stop 151. The shaft 11 may continue to rotate once the body 19 and gate 30 have stopped due to the continued rotational force applied from the drive roll 20 through the gear train 90. The continued rotation maintains torque on the body 19 and gate 30 to maintain the gate 30 in the first position. Likewise, initial rotation in the second direction causes the body 19 and gate 30 to rotate from the first position to the second position. Again, the extent of rotation is limited by the arm 14 contacting against 152 and continued rotation may apply a continued torque to the body 19 and gate 30.

The type of fluid within the chamber 12 may vary depending upon the desired rotational speed and torque needed for the gate 30. A higher viscous fluid may result in quicker rotational speeds of the body 19 and gate 30. Further, the higher viscous fluid may cause a higher torque to be applied to the body 19 and gate 30 to maintain the gate 30 in a particular position. In one embodiment, the total time for the gate 30 to move between positions is about 0.12 seconds. This value includes the time for the drive roll 20 to stop and reverse, the time for the initial gear motion 90, and the time for the fluid damper 10 to physically move the gate 30. Various fluids may be used within the chamber 12, including but not limited to grease, oil, water, and air. Examples of fluid dampers include gear, middle torque gear, and barrel dampers available from Nifco, Inc. of Tokyo, Japan.

Figure 3:
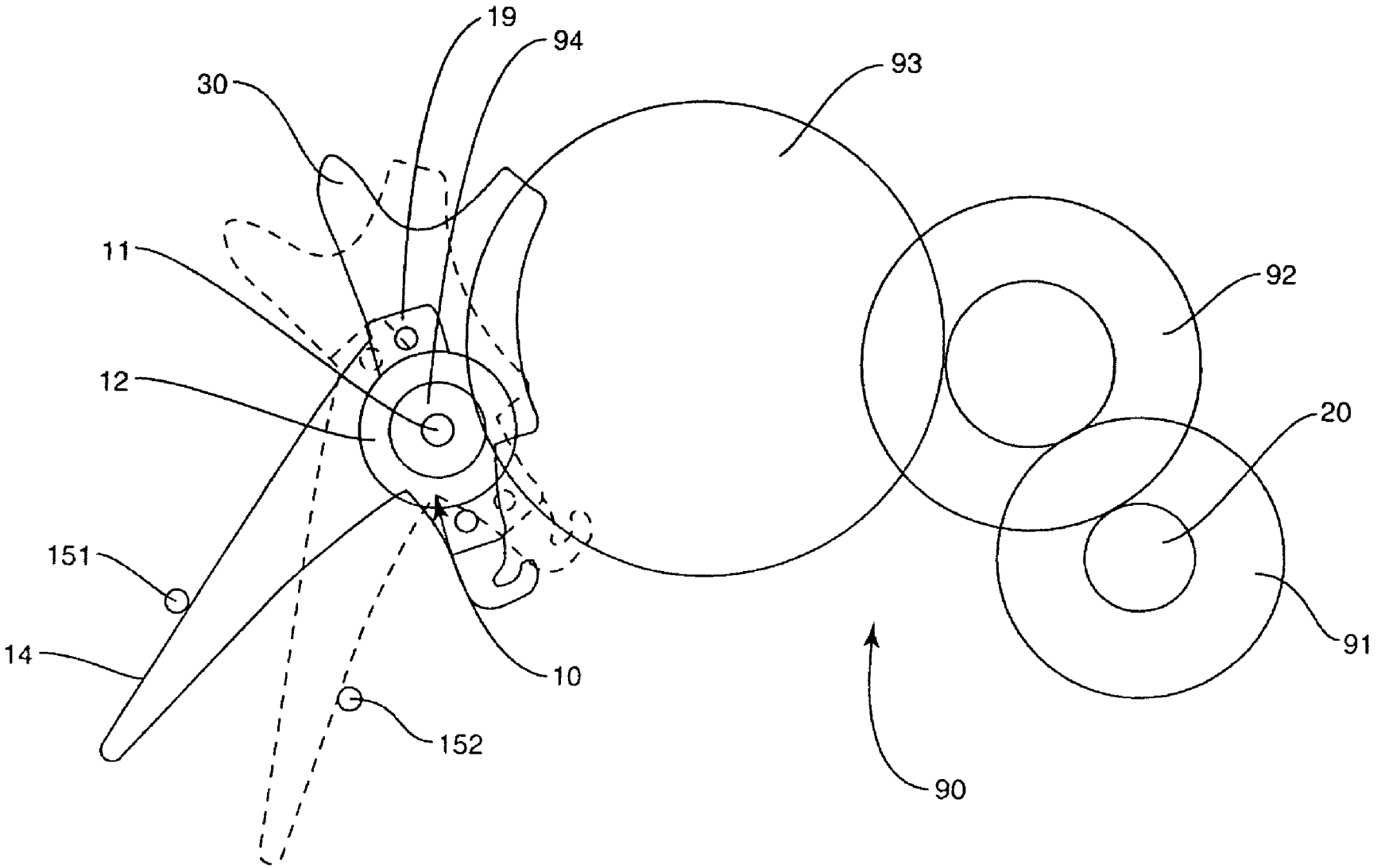
FIG. 3 is a side schematic view of a drive train, fluid damper, and movable gate according to one embodiment.

FIG. 3 illustrates a schematic view of the fluid damper 10 positioned between the drive roll 20 and the gate 30. In this embodiment, the gear train 90 includes a first gear 91 connected to the drive roll 20, and gear 94 connected to the shaft 11. Gears 92, 93 are positioned between gears 91 and 94 and complete the drive train 90. It is understood that a variety of different drive trains 90 may be used for connecting the drive roll 20 and gate 30, and may include different numbers, shapes, and sizes of gears.

Rotation of the drive roll 20 in the first direction rotates the shaft 11, body 19 and gate 30 to the first position as illustrated in solid lines. The extent of rotation is limited by the arm 14 contacting against stop 151. As previously explained, the drive roll 20 and gear train 90 may continue rotating with the shaft 11 rotating independently of the body 19. Rotation of the drive roll 20 in the second direction rotates the shaft 11, body 19, and gate 30 to the second position illustrated in dashed lines. The extent of rotation is limited by the arm 14 contacting against the stop 152. Again, the drive roll 20 and gear train 90 may continue rotating with the shaft 11 rotating independently within the body 19.

Figure 4:
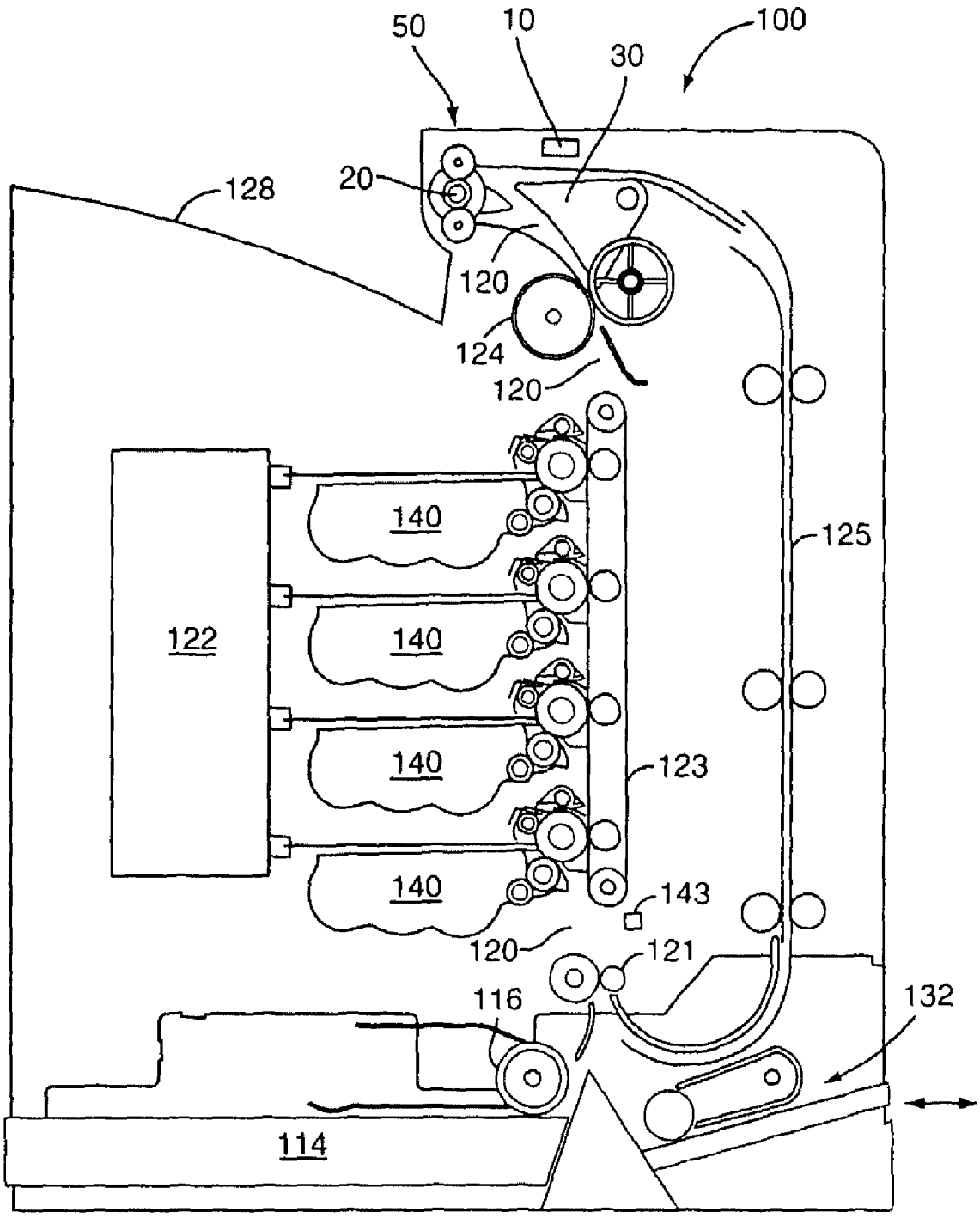
FIG. 4 is a side schematic view of an image forming apparatus according to one embodiment.

In one embodiment, the damper 10, gate 30, and drive roll 20 are positioned at an output of the image forming apparatus 100. FIG. 4 depicts an embodiment with the gate 30 at an output where a first media path splits into a duplex path and an output path. The image forming apparatus 100 includes a media tray 114 with a pick mechanism 116, or multi-purpose feeder 132, for introducing media sheets in the device 100. Media sheets are moved from the input and fed into the first path 120. One or more registration rollers 121 disposed along the first path 120 align the print media and precisely controls its further movement along the media path. A media transport belt 123 forms a section of the media path for moving the media sheets past a plurality of image forming units 140. Color printers typically include four image forming units 140 for printing with cyan, magenta, yellow, and black toner to produce a four-color image on the media sheet. An imaging device 122 forms an electrical charge on a photoconductive member within the image forming units 140 as part of the image formation process.

The media sheet with loose toner is then moved through a fuser 124 that adheres the toner to the media sheet. The media sheet moves past the fuser 124 and is directed by the gate 30 to a dual roll assembly 50 that includes the drive roll 20. The media sheets are either directed through the dual output mechanism 50 into an output tray 128 on the exterior of the image forming apparatus 100, or moved into a duplex path 125 for imaging on a second side.

Figure 5:
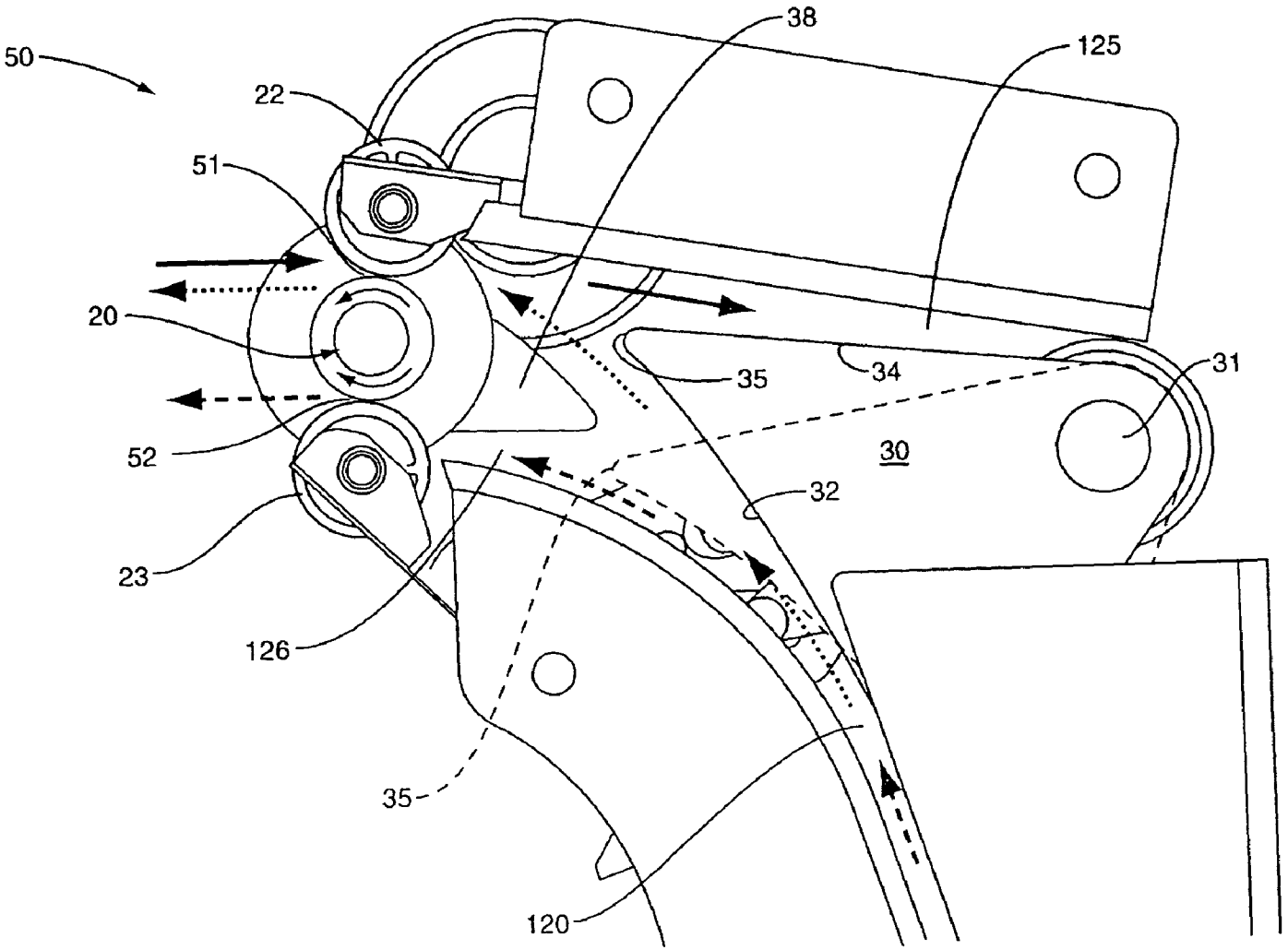
FIG. 5 is a side view of a gate and a dual roll assembly according to one embodiment.

FIG. 5 illustrates the gate 30 and the dual roll assembly 50. The gate 30 includes a first media edge 32 and second media edge 34 that each extend to form a tip 35. In one embodiment, the edges 32, 34 form an acute angle. Gate 30 is movably attached at a pivot 31 and positionable between a first position illustrated in solid lines, and a second position illustrated in dashed lines. In the first position, media sheets moving along the first path 120 ride along the first edge 32 and are directed into the second path 125 that includes a first nip 51. In the second position, media sheets moving along the first path 120 ride along the first edge 32 and are directed into the third path 126 that includes a second nip 52.

The dual roll assembly 50 includes the drive roll 20, a first roll 22, and a second roll 23. The first nip 51 is formed between the drive roll 20 and the first roll 22. The second nip 52 is formed between the drive roll 20 and the second roll 23. The first nip 51 is positioned above the drive roll 20, and the second nip 52 is positioned below the drive roll 20. The drive roll 20 is connected to a motor 80 (FIG. 6) for rotation in both forward and reverse directions. Motor 80 may also rotate the drive roll 20 at a variety of rotational speeds in both the forward and reverse directions. The first roll 22 and the second roll 23 are rotated through the force transferred by the contact with the drive roll 20.

A guide 38 is positioned upstream from the drive roll 20 to further guide the media sheets into the first and second nips 51, 52. Guide 38 has an angular upstream configuration positioned adjacent to the tip 35. Guide 38 is fixedly positioned within the media path with a first edge aligning with the first nip 51, and a second edge aligning with the second nip 52. Embodiments of a gate and a dual roll assembly are disclosed in U.S. patent application Ser. No. 10/790,531 filed Mar. 1, 2004, and herein incorporated by reference in its entirety.

Figure 6:
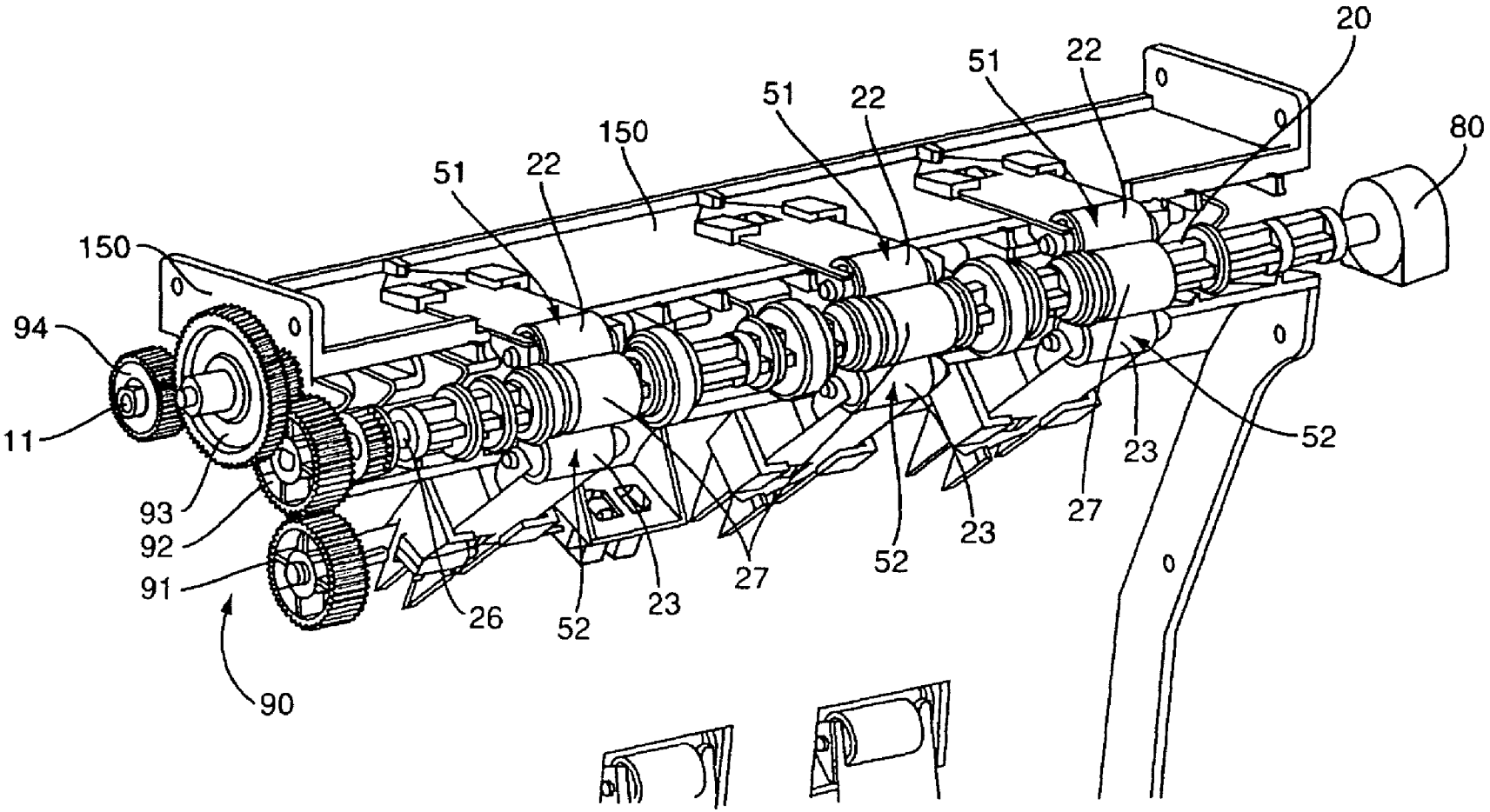
FIG. 6 is a perspective view of a dual roll assembly and a drive gear according to one embodiment.

The drive roll 20, first roll 22, and second roll 23 may have a variety of configurations. In the embodiment of FIG. 6, the drive roll 20 extends along the width of the media path. Drive roll 20 includes a central shaft 26 and a plurality of drive members 27. The drive members 27 have a larger diameter than the shaft 26 and form the nips 51, 52 with the first and second rolls 22, 23 respectively. In this embodiment, first roll 22 and second roll 23 are each a plurality of cylindrical members that contact the drive members 27 of the drive roll 20. The cylindrical members are mounted within the housing 150 that forms a main body of the image forming apparatus 100.

Figure 7:
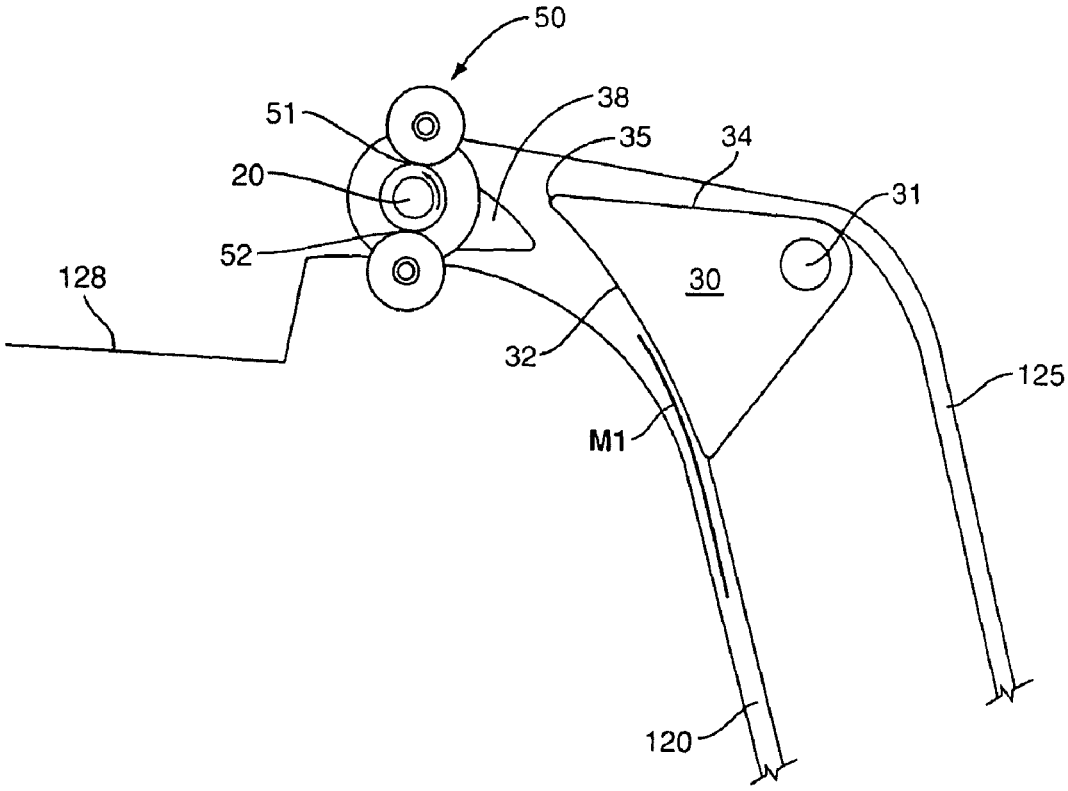
FIGS. 7-10 are side schematic views of steps of moving a gate and directing movement of media sheets within an image forming apparatus according to one embodiment.

One method of controlling the position of the gate 30 and moving media sheets is illustrated in FIGS. 7-10. As illustrated in FIG. 7, the media sheet M1 moves along the first path 120 after passing through the fuser 124. The gate 30 is in the first orientation and the drive roll 20 is rotated in a first direction (counter-clockwise in the embodiment of FIG. 7).

Figure 8:
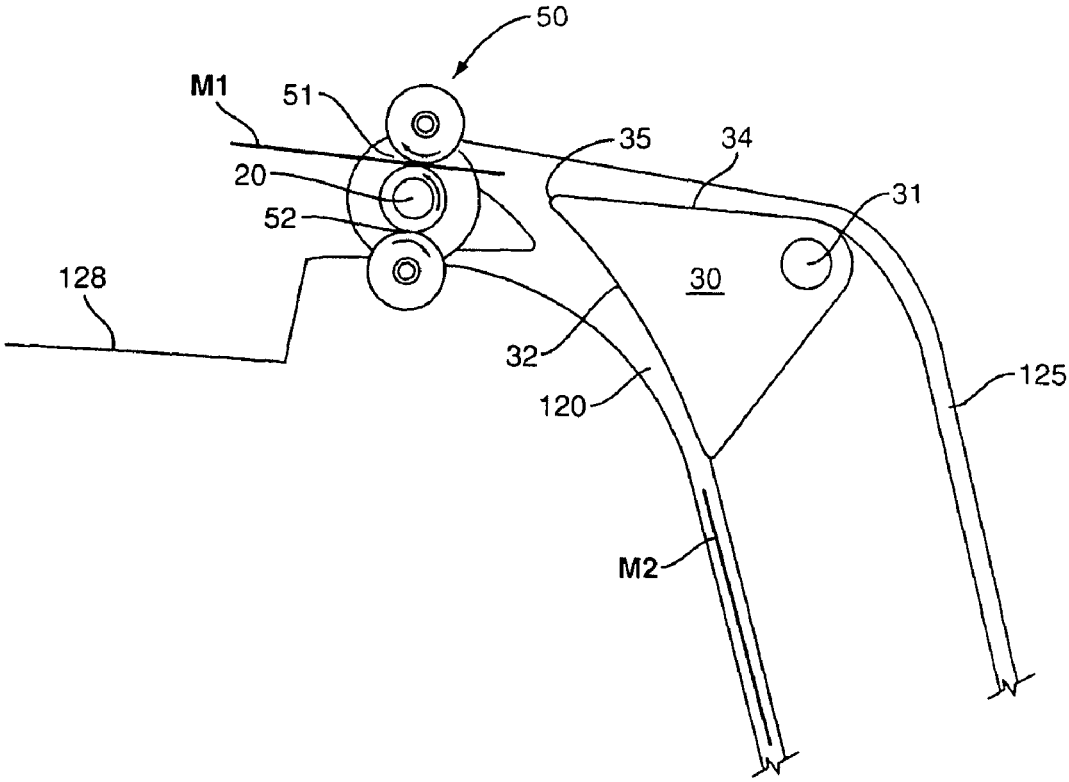

FIG. 8 illustrates the next progression as sheet M1 is positioned within the first nip 51. The drive roll 20 continues to rotate in the first direction and the leading edge of the sheet begins to extend outward from the device 100. Next, the drive roll 20 reverses direction and sheet M1 is duplexed. The direction is reversed while the sheet M1 is still within the control of the first nip 51 and after the trailing edge has cleared the gate tip 35.

Figure 9:
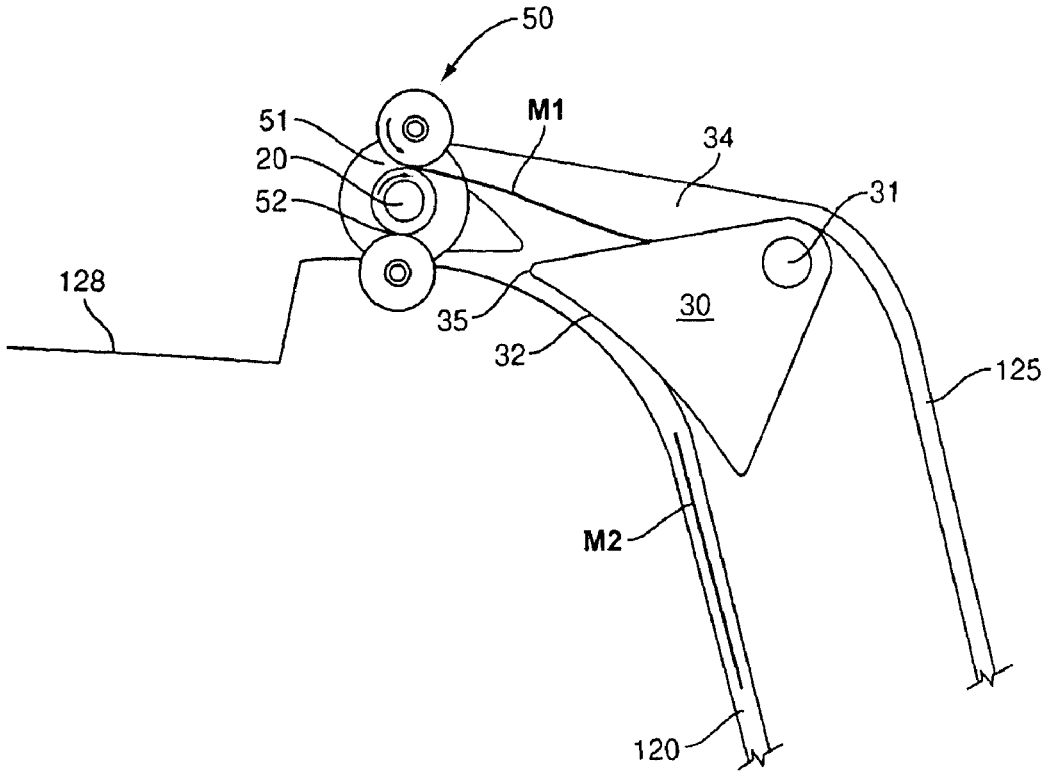

FIG. 9 illustrates the media sheet M1 being driven from the first nip 51 as the drive roll 20 is reversed to a second opposite direction (clockwise as illustrated in FIG. 9). As the drive roll 20 is reversed, gate 30 moves to the second orientation to direct the media sheet M1 along the second path 125, and block the re-entry into the first media path 120. The speed of the fluid damper 10 is such that the gate 30 changes orientations quickly upon the change of drive roll direction. This prevents the leading edge of the media sheet from entering into the wrong media path before the gate 30 changes orientations.

Figure 10:
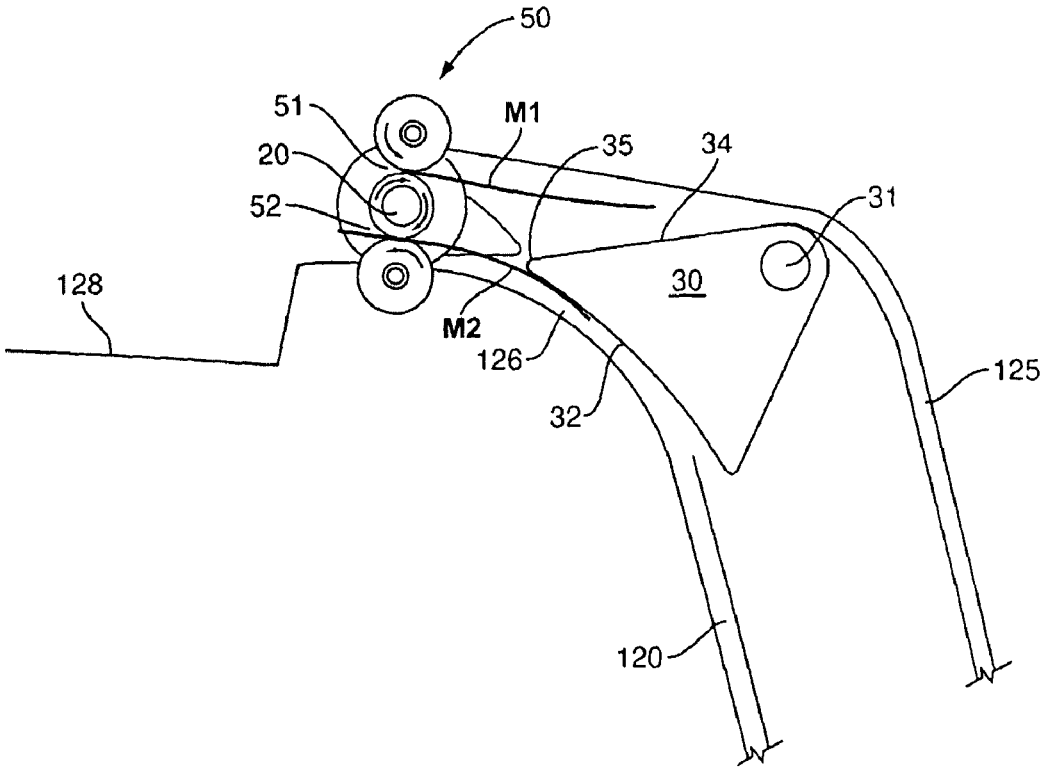

FIG. 10 illustrates the first media sheet M1 leaving the first nip 51 at the same time that the second media sheet M2 is entering the third path 126 formed by the second media nip 52. The drive roll 20 rotates in the second direction (i.e., clockwise in FIG. 11) to move each of the sheets M1, M2 in the correct direction. The first media sheet M1 moves along the duplex path and is re-imaged on a second side. The second media sheet M2 is output through the second nip 52 into the output tray 128.

The embodiment illustrated in FIG. 4 positions the fluid damper 10 and gate 30 at an output from the image forming apparatus 100. The fluid damper 10 and gate 30 may also be positioned at other locations along the media path that require diverting the media sheets. In one embodiment, the fluid damper 10 and gate 30 are positioned at the confluence of the media path 120 and duplexer path 125. In another embodiment, the fluid damper 10 and gate 30 are positioned in the input area where media sheets are introduced to the media path 120 through the input tray 114 and manual feed 132.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A device to direct media sheets moving along a media path within an image forming apparatus, the device comprising:

a housing positioned in proximity to the media path;

a gate movably connected to the housing, the gate including an elongated shape that extends across at least a section of the media path;

a fluid damper operatively connected to the gate and including a chamber to hold fluid and a shaft with a first section positioned within the chamber and a second section extending outward from the chamber, the shaft being operatively connected to a motor;

rotation of the shaft in a first direction moves the fluid damper relative to the housing and causes the gate to move to a first position in the media path to direct the media sheets towards a first part of the media path;

rotation of the shaft in a second direction moves the fluid damper relative to the housing and causes the gate to move to a second position to direct the media sheets towards a second part of the media path; and first and second stops each attached to the housing and spaced apart a predetermined distance, the gate contacting against the first stop when the shaft rotates in the first direction and contacting against the second stop when the shaft rotates in the second direction.

2. The device of claim 1, further comprising an arm that extends outward from the gate and contacts against the first and second stops.

3. The device of claim 1, wherein the fluid damper further includes a body with an outwardly-extending arm, the body being operatively attached to the gate with the chamber being attached to the body.

4. The device of claim 1, wherein the gate includes a substantially triangular section that extends across at least the section of the media path, the triangular section being positioned on a first side of the housing and the fluid damper being positioned on a second side of the housing.

5. The device of claim 1, wherein the gate moves between the first position and the second position in about 0.12 seconds.

6. A device to direct media sheets moving along a media path within an image forming apparatus, the device comprising:

a motor that operates in a first rotational direction and a second rotational direction;

a housing positioned in proximity to the media path;

a fluid damper operatively connected to the gate;

a gear train extending between the motor and the fluid damper;

a gate movably connected to the housing that extends outward from the fluid damper and further extends across at least a section of the media path;

a first force of the motor operating in the first rotational direction is transferred through the gear train to the fluid damper to move the fluid damper relative to the housing and cause the gate to move to a first position in the media path to direct the media sheets towards a first part of the media path;

a second force of the motor operating in the second rotational direction is transferred through the gear train to the fluid damper to move the fluid damper relative to the housing and cause the gate to move to a second position in the media path to direct the media sheets towards a second part of the media; path;

wherein the gate further includes an outwardly-extending arm that contacts against first and second stops positioned on the housing at spaced apart locations; and first and second stops positioned on the housing and being spaced apart a predetermined distance, the gate contacts the first stop when the motor rotates in the first rotational direction and contacts the second stop when the motor rotates in the second rotational direction.

7. The device of claim 6, further comprising a drive roll that extends into the media path to move the media sheets, the drive roll being connected to the motor.

8. The device of claim 7, further comprising a first roll positioned on a first side of the drive roll and forming a first nip and a second roll positioned on a second side of the drive roll and forming a second nip, the gate directing the media sheets towards the first nip when the motor operates in the first direction and directing the media sheets towards the second nip when the motor operates in the second direction.

9. The device of claim 6, wherein the gate includes a substantially triangular section that extends across at least the section of the media path, the triangular section being positioned on a first side of the housing and the fluid damper being positioned on a second side of the housing.

10. The device of claim 6, wherein the gate moves between the first position and the second position in about 0.12 seconds.

11. A method of directing media sheets moving along a media path of an image forming apparatus, the method comprising:

driving a motor in a first rotational direction;

transferring a first rotational force from the motor to a fluid damper;

pivoting the fluid damper to a first orientation relative to a housing of the image forming apparatus;

moving a gate within the media path to a first position and directing the media sheets towards a first part of the media path;

driving the motor in a second rotational direction;

transferring a second rotational force from the motor to the fluid damper;

pivoting the fluid damper to a second orientation relative to the housing;

moving the gate within the media path to a second position and directing the media sheets towards a second part of the media path; and contacting an arm of the gate against a first stop on the housing when the motor rotates in the first rotational direction and contacting the arm of the gate against a second stop on the housing when the motor rotates in the second rotational direction, wherein the gate further includes an outwardly-extending arm that contacts the first and second stops.

12. The method of claim 11, further comprising driving a first nip when the motor rotates in the first rotational direction and moving the gate to the first position and directing the media sheets towards the first nip.

13. The method of claim 12, further comprising driving a second nip when the motor rotates in the second rotational direction and moving the gate to the second position and directing the media sheets toward the second nip.

14. The method of claim 11, wherein the step of transferring the first rotational force from the motor to the fluid damper comprises driving a gear train that extends between the motor and the fluid damper.

15. The method of claim 11, further comprising moving the gate from the first position to the second position in about 0.12 seconds.

16. The method of claim 11, further comprising moving the gate from the first position to the second position and directing the media sheets from an input section toward a transfer section of the media path.

17. A device to direct media sheets moving along a media path within an image forming apparatus, the device comprising:

a motor that operates in a first rotational direction and a second rotational direction;

a housing positioned in proximity to the media path;

a fluid damper operatively connected to the gate;

a gear train extending between the motor and the fluid damper;

a gate movably connected to the housing that extends outward from the fluid damper and further extends across at least a section of the media path;

a first force of the motor operating in the first rotational direction is transferred through the gear train to the fluid damper to move the fluid damper relative to the housing and cause the gate to move to a first position in the media path to direct the media sheets towards a first part of the media path;

a second force of the motor operating in the second rotational direction is transferred through the gear train to the fluid damper to move the fluid damper relative to the housing and cause the gate to move to a second position in the media path to direct the media sheets towards a second part of the media path; and first and second stops positioned on the housing and being separated by a predetermined distance, the gate contacts the first stop when the motor rotates in the first rotational direction and contacts the second stop when the motor rotates in the second rotational direction.

* * * * *